US009697964B2

(12) United States Patent
Kral et al.

(10) Patent No.: US 9,697,964 B2
(45) Date of Patent: Jul. 4, 2017

(54) LOCOMOTIVE POSITIVE POWER BUS CONTACTOR METHOD OF ASSEMBLY

(71) Applicant: Progress Rail Services Corp., Albertville, AL (US)

(72) Inventors: John Franklin Kral, Plainfield, IL (US); Sidarta Fornari Beltramin, Curitiba (BR)

(73) Assignee: Progress Rail Services Corporation, Albertville, AL (US)

( * ) Notice: Subject to any disclaimer, the term of this patent is extended or adjusted under 35 U.S.C. 154(b) by 275 days.

(21) Appl. No.: 14/559,400

(22) Filed: Dec. 3, 2014

(65) Prior Publication Data

US 2015/0082630 A1 Mar. 26, 2015

Related U.S. Application Data

(62) Division of application No. 13/550,726, filed on Jul. 17, 2012, now Pat. No. 8,933,359.

(60) Provisional application No. 61/581,448, filed on Dec. 29, 2011.

(51) Int. Cl.

| | |
|---|---|
| ***H01H 11/04*** | (2006.01) |
| ***H01H 9/44*** | (2006.01) |
| ***H01H 33/18*** | (2006.01) |
| ***H01H 9/34*** | (2006.01) |

(52) U.S. Cl.

CPC ..... *H01H 11/04* (2013.01); *H01H 9/345* (2013.01); *H01H 9/44* (2013.01); *H01H 33/18* (2013.01); *Y10T 29/49117* (2015.01); *Y10T 29/49204* (2015.01)

(58) Field of Classification Search

CPC ..... H01H 9/44; H01H 11/04
USPC ..... 105/35, 49; 218/1, 22, 23, 149
See application file for complete search history.

(56) References Cited

U.S. PATENT DOCUMENTS

| | | | |
|---|---|---|---|
| 1,796,069 | A | 3/1931 | Viele |
| 2,020,935 | A | 11/1935 | Ellis et al. |
| 2,967,921 | A | 1/1961 | Carver |
| 3,050,602 | A | 8/1962 | Korte et al. |
| 3,284,601 | A | 11/1966 | Harrington |
| 3,612,796 | A | 10/1971 | Doos |
| 3,708,769 | A | 1/1973 | Caltabiano |
| 3,728,506 | A | 4/1973 | Heehler et al. |
| 3,992,599 | A | 11/1976 | Halbach |
| 4,038,626 | A | 7/1977 | Haydu et al. |
| 4,506,243 | A | 3/1985 | Okado et al. |
| 5,825,269 | A | 10/1998 | Koppmann |
| 7,928,685 | B2 | 4/2011 | Dornauer et al. |
| 2008/0148993 | A1 | 6/2008 | Mack |

FOREIGN PATENT DOCUMENTS

| | | | |
|---|---|---|---|
| EP | 0 515 731 | A2 | 12/1992 |

*Primary Examiner* — Zachary Kuhfuss
(74) *Attorney, Agent, or Firm* — Finnegan, Henderson, Farabow, Garrett & Dunner, LLP

(57) ABSTRACT

A method of manufacturing a power contactor from an existing contactor having a magnetic amplifier that comprises a blowout coil and a ferromagnetic core, and an arc chute for extinguishing an arc generated by opening the existing contactor under a current load is disclosed. The method includes removing a bolt assembly from the existing contactor and at least one side plate from the existing contactor. The method also includes removing the ferromagnetic core from the existing contactor.

5 Claims, 6 Drawing Sheets

LOCOMOTIVE POSITIVE POWER BUS CONTACTOR METHOD OF ASSEMBLY

This is a divisional of application Ser. No. 13/550,726, filed on Jul. 17, 2012, and claims the benefit of priority of U.S. Provisional Patent Application No. 61/581,448, which was filed on Dec. 29, 2011, all of which are incorporated herein by reference.

TECHNICAL FIELD

The present disclosure relates generally to power contactors and, more particularly, to a power contactor capable of withstanding discontinuous current.

BACKGROUND

Power contactors are basically switching devices that are capable of closing and opening a circuit under substantial load currents. Diesel-electric locomotives traditionally use one or more power contactors to connect traction motors to a positive power bus. Typically, these contactors incorporate a device known as an arc chute to help dissipate the electric arc generated when the power contactor is opened while current is flowing through the power transmission circuit. Some modern locomotives incorporate a pulse-width modulation switching system, such as a chopper, in the primary current path of traction motor systems to more effectively regulate the operation of the traction motors. This pulse-width modulation switching system results in a discontinuous current at the power contactor. As a result, the power contactor, which was designed primarily for use in DC (non-pulsed) applications, is subjected to a pseudo-AC (pulsed) current.

One such example of a conventional power contactor is described in U.S. Pat. No. 3,992,599 ("the '599 patent"). The '599 patent purportedly discloses a contactor of high-current capacity that includes a blowout coil, which comprises a plurality of helical turns of a copper strap. The blowout coil surrounds a ferromagnetic core attached to the contactor by ferromagnetic flux-carrying pole pieces. As the blowout coil is within the primary current path, discontinuous current will induce current in the ferromagnetic core and flux-carrying pole pieces.

Conventional power contactors that include a coil surrounded by a ferromagnetic core, such as the one described in the '599 patent, have significant drawbacks, particularly when used in applications that require discontinuous or "pulsed" current. In particular, induction caused by the frequent, periodic change in pulsed or discontinuous current results in overheating of metallic contactor components not in the primary current path, including the ferromagnetic core, the bolt assembly, and any other metallic material, such as side plates. Such heating can be extreme, particularly in locomotive applications, where current is high and pulse width tends to be fairly short. If allowed to persist, extreme temperatures can potentially result in catastrophic failure of the materials, which can lead to malfunction of the power contactor. Because proper operation of the power contactor is critical to maintaining operation of the traction motor, the effects of excessive temperatures in the power contactor components due to the induction caused by pulsed or discontinuous currents must be mitigated.

The presently disclosed locomotive power contactor is directed to overcoming one or more of the problems set forth above and/or other problems in the art.

SUMMARY OF THE INVENTION

In accordance with one aspect, the present disclosure is directed to a method of manufacturing a power contactor from an existing contactor having a magnetic amplifier that comprises a blowout coil and a ferromagnetic core, and an arc chute for extinguishing an arc generated by opening the existing contactor under a current load. The method may include removing a bolt assembly from the existing contactor and at least one side plate from the existing contactor. The method may also include removing the ferromagnetic core from the existing contactor.

According to another aspect, the present disclosure is directed to a power contactor. The power contactor may include a stationary bus bar and a stationary contact connected to the stationary bus bar. The power contactor may also include a movable contact capable of moving into engagement with the stationary contact. The power contactor may also include a blowout coil, one end of which may be connected to the stationary bus bar. The blowout coil may include a plurality of helical turns of conductive material surrounding a substantially nonmetallic core.

In accordance with another aspect, the present disclosure is directed to a locomotive. The locomotive may include a plurality of axles and a plurality of pairs of wheels, each pair of wheels attached to one of the axles. The locomotive may include a plurality of armatures, each armature rotatably coupled to one of the axles. The locomotive may also include a chopper connected in series with at least one of the armatures. The locomotive may also include a power contactor connected in a primary current path of the chopper. The power contactor may include a stationary bus bar and a stationary contact connected to the stationary bus bar. The power contactor may also include a movable contact capable of moving into engagement with the stationary contact. The power contactor may also include a blowout coil, one end of which may be connected to the stationary bus bar. The blowout coil may include a plurality of helical turns of conductive material surrounding a substantially nonmetallic core.

DETAILED DESCRIPTION

Figure 1:
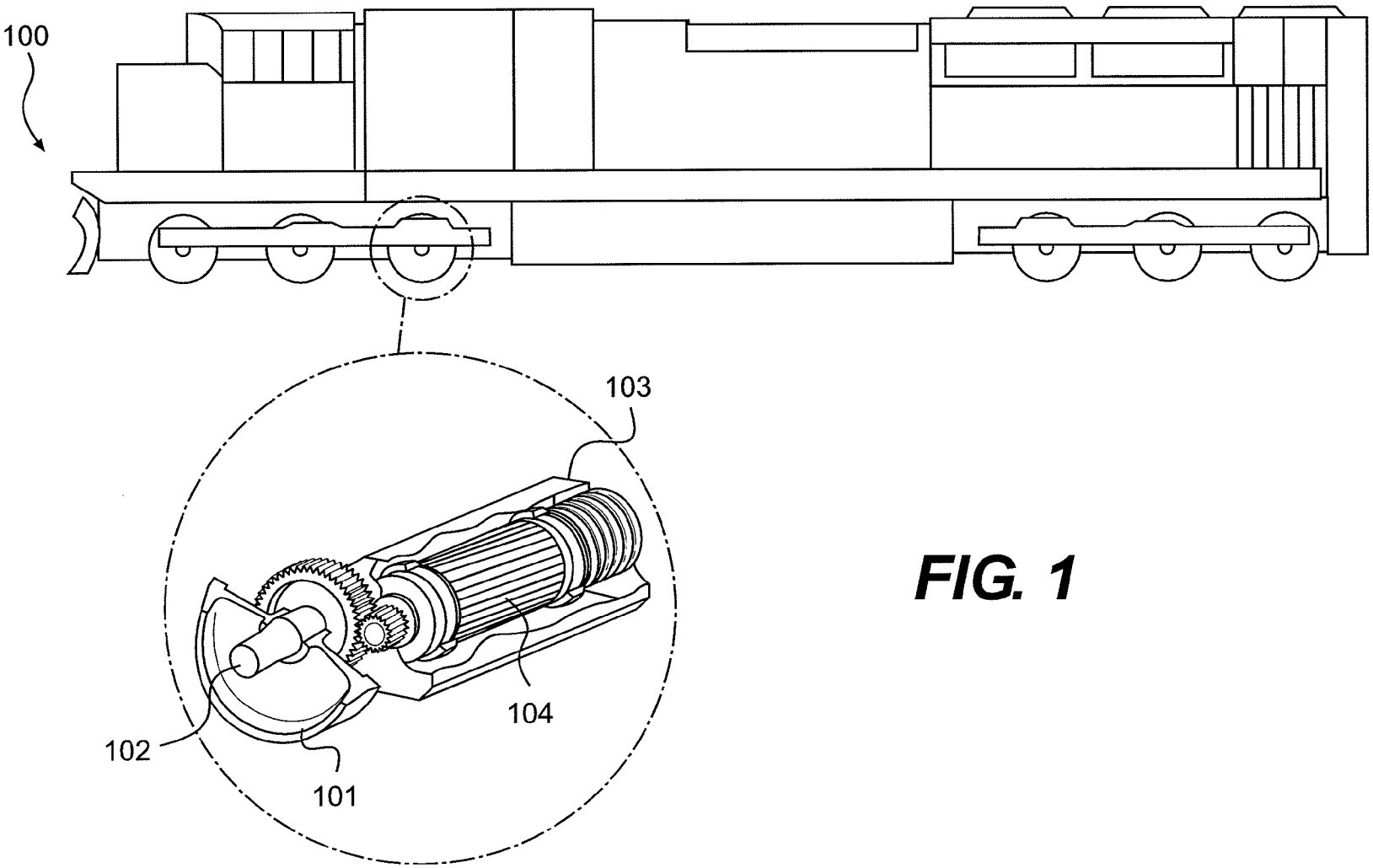
FIG. 1 illustrates an exemplary locomotive.

FIG. 1 illustrates an exemplary locomotive 100 in which traction systems may be implemented consistent with the disclosed embodiments. Locomotive 100 may be any electrically powered rail vehicle employing DC traction motors for propulsion. Furthermore, any electrically powered vehicle employing DC traction motors for propulsion could also incorporate the discontinuous power contactor consistent with the disclosed embodiments. According to the exemplary embodiment illustrated in FIG. 1, locomotive 100 may include six pairs of wheels 101, with each pair of wheels 101 attached to an axle 102 that is rotatably coupled to a traction motor 103. Traction motors 103 may each include an armature 104. Locomotive 100 may use a high-power transmission circuit to supply electric power for operating traction motors 103.

High-power transmission circuits often incorporate contactors for making and breaking a current path. In high-power applications for locomotives 100, these contactors must be able to handle power requirements reaching 2.8 megawatts ("MW") and current loads of up to 2000 Amperes (A). Traditionally, locomotives 100 incorporate a conventional contactor into its power transmission circuits.

Figure 2:
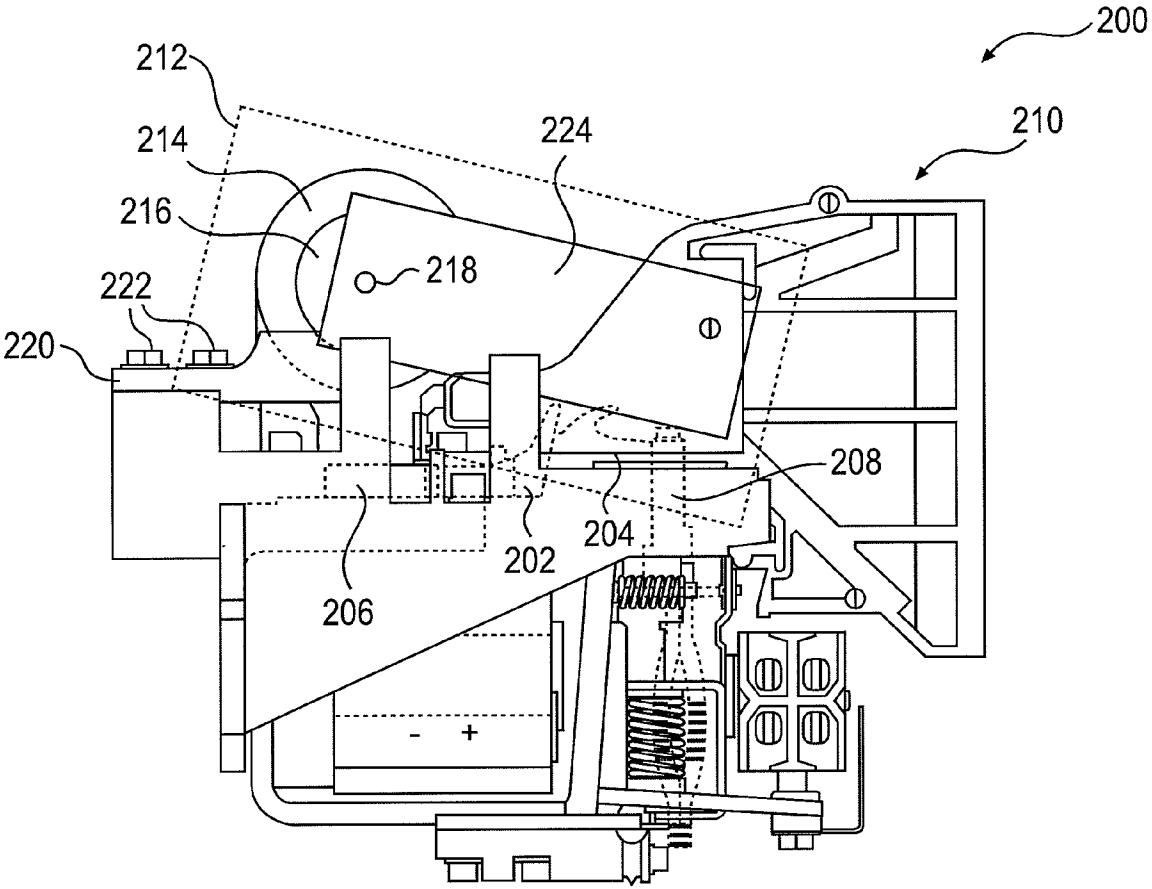
PRIOR ART FIG. 2
FIG. 2 illustrates a conventional contactor susceptible to overheating under discontinuous current conditions.

FIG. 2 shows conventional contactor 200. Conventional contactor 200 may be a single-pole, single-throw switch and may have a contact rating of 1200 A. In some embodiments, conventional contactor 200 may be capable of withstanding up to 2000 Amperes of direct current ("ADC"). In an exemplary embodiment, conventional contactor 200 may comprise Part Number 8458534, supplied by Electro Motive Diesel (EMD).

Conventional contactor 200 may comprise a movable contact 202 and a stationary contact 204 to make and break the direct current circuit. Stationary contact 204 may be electrically coupled to a stationary bus bar 206. For example, stationary contact 204 may be secured to stationary bus bar 206 such that current traveling through stationary contact 204 may also flow through stationary bus bar 206. Stationary bus bar 206 may comprise conductive material, such that when current is applied to stationary contact 204, the current flows through stationary bus bar 206. Movable contact 202 may be electrically coupled to a movable bus bar 208. Movable bus bar 208 may cause movable contact 202 to electrically engage with stationary contact 204 to complete the circuit within conventional contactor 200. Movable bus bar 208 may comprise conductive material, such that current flowing through movable contact 202 may also flow through movable bus bar 208.

When conventional contactor 200 opens under a high current, it may produce an arc across movable contact 202 and stationary contact 204. Because arcing is characterized by a surge in current (and corresponding heating) that can damage the electrical components, conventional contactor 200 may include an arc chute 210 and a magnetic amplifier 212 that cooperate to extinguish the arc. Magnetic amplifier 212 may include a blowout coil 214. As conventional contactor 200 opens under a current load, current may travel through blowout coil 214 and into arc chute 210, where the arc may be extinguished. Arc chute 210 may include permanent magnets to create a magnetic field within arc chute 210 for extinguishing the arc. When current travels through blowout coil 214, magnetic amplifier 212 creates a magnetic field to amplify the magnetic field within arc chute 210. The increased magnetic field in arc chute 210 enables arc chute 210 to extinguish large arcs. This allows conventional contactor 200 to open under a higher current than otherwise would be possible.

Blowout coil 214 of magnetic amplifier 212 may comprise a series of helical turns of conductive material wrapped around ferromagnetic core 216. In one embodiment, blowout coil 214 may comprise copper strap, copper wire, or some other conductor capable of withstanding high currents. It is contemplated that blowout coil 214 may comprise any suitable materials and sizes capable of conducting currents of 2000 A.

The number of turns of conductive material that blowout coil 214 comprises may vary. In one embodiment, blowout coil 214 may comprise at least two turns. In other embodiments, blowout coil 214 may comprise three or more turns. The number of helical turns may depend on the power requirements of a particular application of conventional contactor 200. Furthermore, the number of helical turns may vary based on the size and nature of the material used for blowout coil 214.

One end of blowout coil 214 may be electrically coupled to stationary bus bar 206. The other end of blowout coil 214 may be electrically coupled to a connector plate 220 having terminal connections 222 for connecting an electrical load to conventional contactor 200. As such, closing conventional contactor 200 completes a circuit from the electrical load connected to terminal connections 222 and through connector plate 220 and blowout coil 214.

In addition to blowout coil 214, magnetic amplifier 212 may comprise components that amplify a magnetic field within arc chute 210 for extinguishing electric arcs occurring when conventional contactor 200 is opened. To sufficiently amplify the magnetic field, magnetic amplifier 212 may include a ferromagnetic core 216 that is held within blowout coil 214 by a bolt assembly 218 and a pair of side plates 224. As current passes through the primary current path provided by blowout coil 214, which is wrapped around ferromagnetic core 216, current is induced within ferromagnetic core 216, which, in turn, increases the magnetic flux stored within ferromagnetic core 216.

A pair of side plates 224 may connect magnetic amplifier 212 to arc chute 210 and may be configured to electrically transfer magnetic flux generated by magnetic amplifier 212 to arc chute 210. In one embodiment, side plates 224 may embody any material suitable for electrically transferring magnetic flux from one location to another. Each side plate 224 may connect to a respective end of ferromagnetic core 216. Side plates 224 may engage with arc chute 210, transferring the magnetic flux generated by blowout coil 214 and ferromagnetic core 216 to the magnets housed within arc chute 210.

Figure 3:
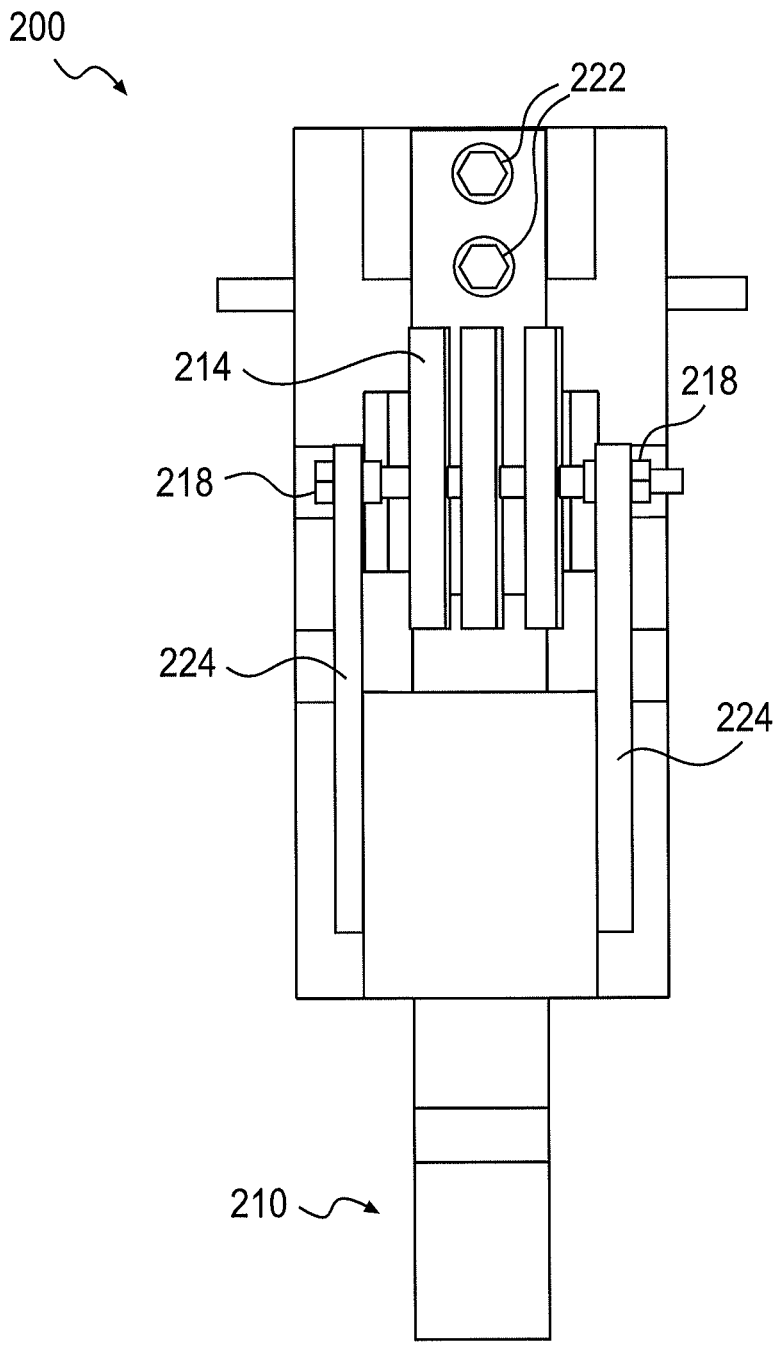
PRIOR ART FIG. 3
FIG. 3 shows a top view of the conventional contactor of FIG. 2.

FIG. 3 shows a top view of conventional contactor 200. Side plates 224 may stand vertically in parallel with each other and connect magnetic amplifier 212 to arc chute 210. Ferromagnetic core 216 may be disposed between and electrically coupled to side plates 224, so that each end of ferromagnetic core 216 connects to a respective side plate 224. Bolt assembly 218 connects each end of ferromagnetic core 216 to a respective side plate 224. Blowout coil 214 may also be situated between side plates 224, and the windings of blowout coil 214 may at least partially surround ferromagnetic core 216.

Conventional contactor 200 is less desirable for use with discontinuous (or pseudo-AC) current. As explained above, ferromagnetic core 216, side plates 224, and bolt assembly 218, though not in the primary current path, may overheat when discontinuous current is applied to conventional contactor 200. In this application, the discontinuous current traveling through blowout coil 214 may induce current in the parts of conventional contactor 200 outside the primary current path. Thus, according to one embodiment, a conventional contactor 200 may be modified to prevent overheating when used with discontinuous current.

Figure 4:
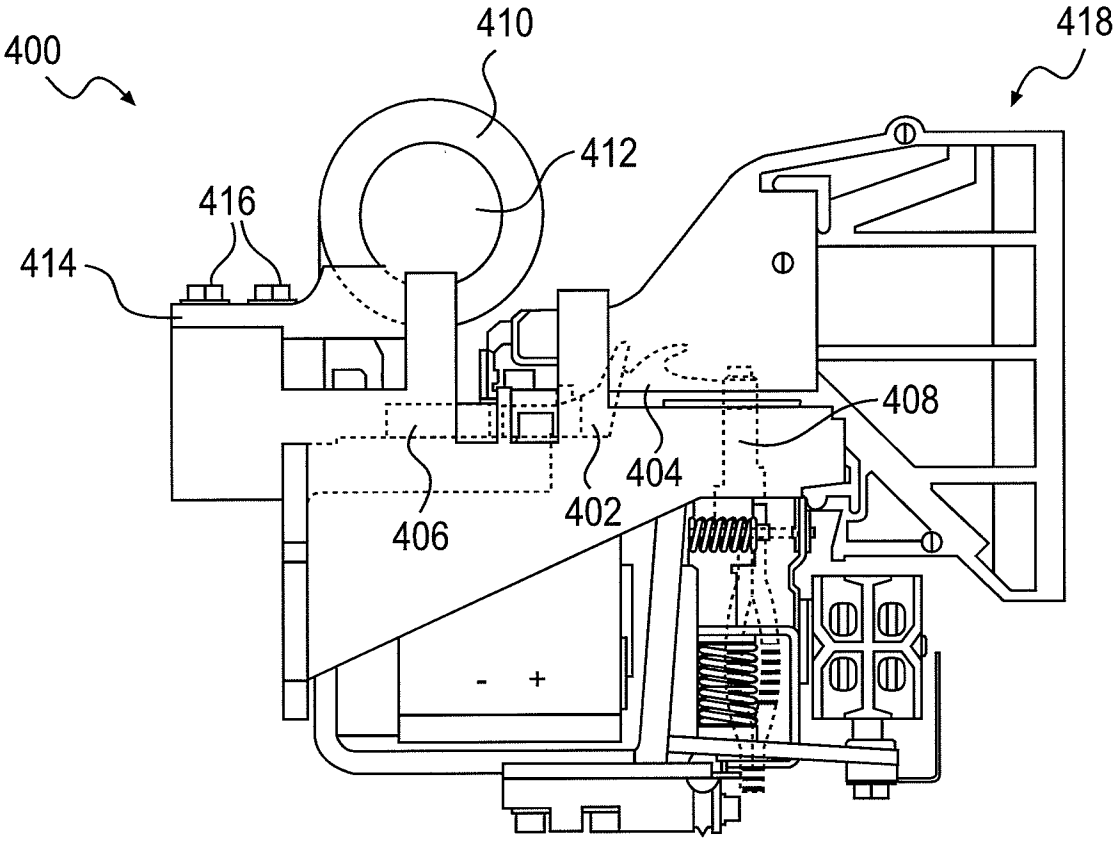
FIG. 4 illustrates an exemplary power contactor capable of operating under discontinuous current conditions.
Figure 5:
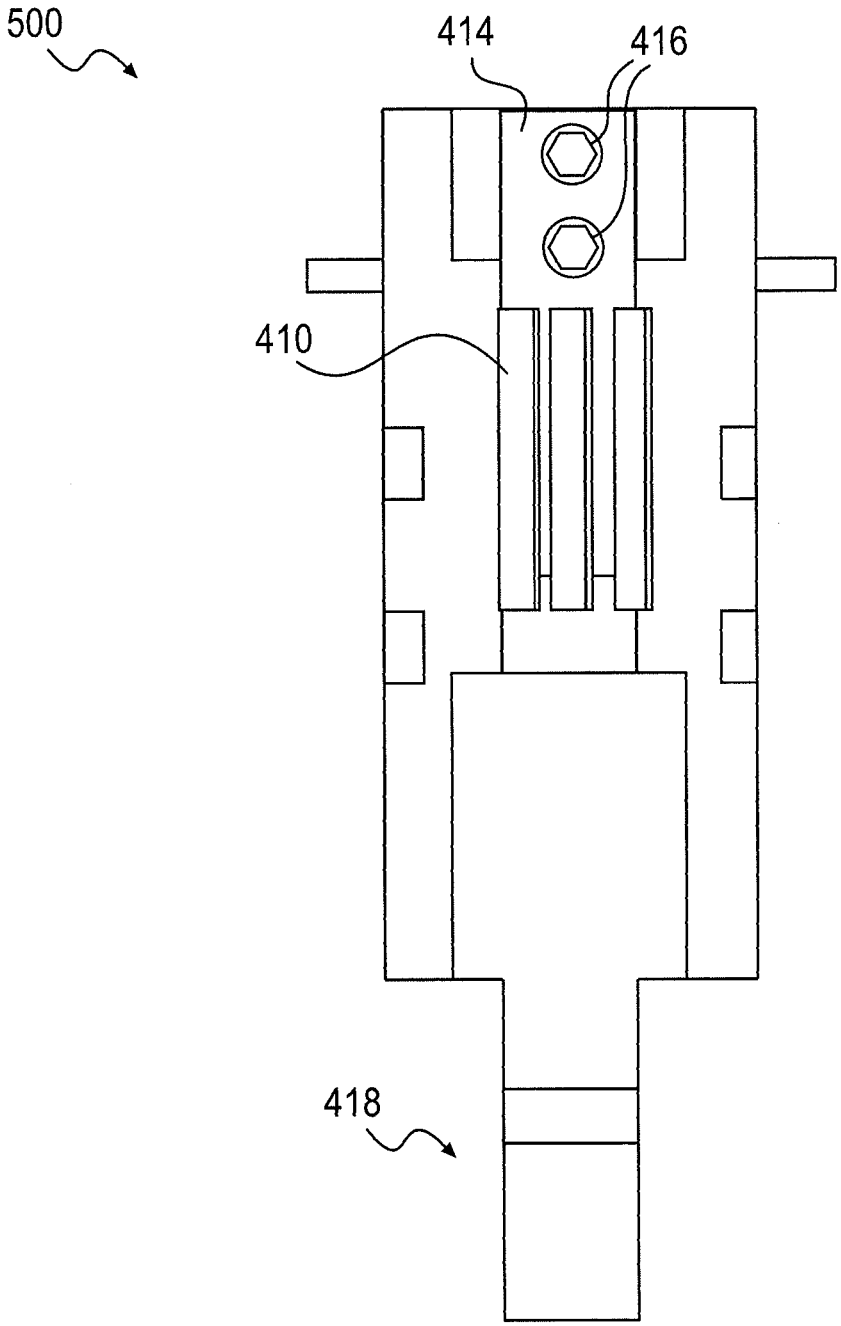
FIG. 5 shows a top view of the exemplary power contactor of FIG. 4.

FIGS. 4 and 5 show a power contactor 400, capable of withstanding discontinuous current conditions. Unlike conventional contactor 200, power contactor 400 does not include a magnetic amplifier. Power contactor 400 may share some power characteristics with conventional contactor 200. In one embodiment, power contactor 400 may be rated to operate normally under 2000 ADC and 1500 V. Power contactor 400 may have applications within the power transmission circuitry of locomotive 100, which can use upwards of 2.8 MW of power.

FIG. 4 illustrates a side view of power contactor 400. Power contactor 400 may include movable contact 402 and stationary contact 404 for making and breaking a circuit. Stationary contact 404 may connect to stationary bus bar 406. In one embodiment, stationary contact 404 may be electrically coupled to stationary bus bar 406, such that current traveling to stationary contact 404 may also travel through stationary bus bar 406. Alternatively or additionally, stationary contact 404 may connect to a first end of stationary bus bar 406. Movable contact 402 may connect to a movable bus bar 408. In one embodiment, movable contact 402 may be electrically coupled to movable bus bar 408. Movable bus bar 408 may cause movable contact 402 to move into electrical engagement with stationary contact 404 to complete the circuit within power contactor 400. Movable bus bar 408 may also cause movable contact 402 to disconnect from stationary contact 404 to break the circuit within power contactor 400. Stationary bus bar 406 and movable bus bar 408 may comprise electrically conductive material.

Power contactor 400 may also comprise a blowout coil 410. Blowout coil 410 may comprise a series of helical turns of conductive material at least partially wrapped around a nonmagnetic core 412. In one embodiment, blowout coil 410 may comprise copper strap. It is contemplated that blowout coil 410 may comprise any suitable materials and sizes capable of conducting current at 2000 A.

The number of helical turns of conductive material blowout coil 410 comprises may vary. In one embodiment, blowout coil 410 may comprise at least two turns. In another embodiment, blowout coil 410 may comprise three turns of copper strap. The number of helical turns may depend on the power requirements of a particular application of power contactor 400. Furthermore, the number of helical turns may vary based on the size and nature of the material used for blowout coil 410.

Blowout coil 410 may be electrically coupled to stationary bus bar 406 at one end. The other end of blowout coil 410 may be electrically coupled to a connector plate 414 having terminal connections 416 for connecting an electrical load to power contactor 400.

Nonmagnetic core 412 may be constructed of any material that is resistant to the storage of large amounts of magnetic flux. In one embodiment, nonmagnetic core 412 may comprise a nonmetallic core. For example, nonmagnetic core 412 may comprise a dielectric core. In another embodiment, nonmagnetic core 412 may comprise an air core. Nonmagnetic core 412 may function as an electrical insulator to prevent current flowing through blowout coil 410 from inducing current in other portions of power contactor 400.

Similar to conventional contactor 200, power contactor 400 may also comprise an arc chute 418 for extinguishing the arc created when movable contact 402 electrically separates from stationary contact 404 under a load. Without the amplification capabilities magnetic amplifier 212 provides to conventional contactor 200, the arc extinguishing abilities of power contactor 400 may differ from the arc extinguishing abilities of conventional contactor 200. This may result in a lower interrupt rating for power contactor 400 than conventional contactor 200. For example, power contactor 400 may have an interrupt rating of up to 1000 ADC.

Power contactor 400 may be configured to operate under both direct current and discontinuous current conditions. Because power contactor 400 does not contain metallic materials located within (or in proximity to) blowout coil 410, the heating effects associated with induction caused by the discontinuous current traveling through blowout coil 410 are reduced, particular when compared with conventional contactors. Thus, portions of power contactor 400 not in the primary current path will typically not be subjected to excessive heating when discontinuous current travels through the primary current path.

FIG. 5 shows a top view of power contactor 400 comprising an air core. In this embodiment, power contactor 400 does not include side plates or bolt assembly, as in conventional contactor 200. As FIG. 5 shows, power contactor 400 has a similar configuration to conventional contactor 200 illustrated in FIG. 3. Arc chute 418 may be located at one end of the top of power contactor 400. Blowout coil 410 may be arranged at the other end of the top of power contactor 400. As nonmagnetic core 412 in this embodiment comprises an air core, power contactor 400 in FIG. 5 does not show side plates or a bolt assembly, which are generally used to affix nonmagnetic core 412 to power contactor 400.

One method of manufacturing power contactor 400 may include modifying existing conventional contactor 200. This method may include at least partly removing magnetic amplifier 212 from conventional contactor 200 to create power contactor 400 capable of withstanding discontinuous current. In one embodiment, conventional contactor may be Part Number 8458534, supplied by EMD. It is contemplated that the presently disclosed embodiments may be applicable to any power contactor having a magnetic amplifier that comprises a blowout coil wrapped around a metallic core or otherwise surrounding metallic components.

Manufacturing power contactor 400 from existing conventional contactor 200 may include removing bolt assembly 218 from the existing contactor. Bolt assembly 218 may be used in conventional contactor 200 to attach ferromagnetic core 216 to conventional contactor 200. By removing bolt assembly 218, it may now be possible to disconnect and remove other components of magnetic amplifier 212.

Manufacturing power contactor 400 may also include removing at least one side plate 224 from existing conventional contactor 200. In conventional contactor 200, side plates 224 may attach ferromagnetic core 216 to arc chute 210. Side plates 224 may comprise conductive material. Under discontinuous current conditions, side plates 224 may experience inductive heating as a result of a magnetic field created by blowout coil 214. Removing side plates 224 may ensure these components do not overheat, which may damage power contactor 400. At least one reason to remove side plates 224 is to allow ferromagnetic core 216 to be removed. As such, it is possible to remove only one side plate 224. However, second side plate 224 may be removed as well without affecting the functionality of power contactor 400. Furthermore, side plates 224 may be reattached once ferromagnetic core 216 has been removed.

The method may also include removing ferromagnetic core 216 from the existing contactor. In one embodiment, this may include completely removing ferromagnetic core 216 from conventional contactor 200. Additionally, this method may include replacing ferromagnetic core 216 with another type of core. In one embodiment, this may include inserting a nonmagnetic core into blowout coil 410. For example, nonmagnetic core may comprise a nonmetallic core. In another embodiment, nonmagnetic core may comprise a dielectric core. In embodiments in which ferromagnetic core 216 is replaced with nonmagnetic core 412, side plates 224 and bolt assembly 218 may be reincorporated to secure the nonmagnetic core within blowout coil 410.

Figure 6:
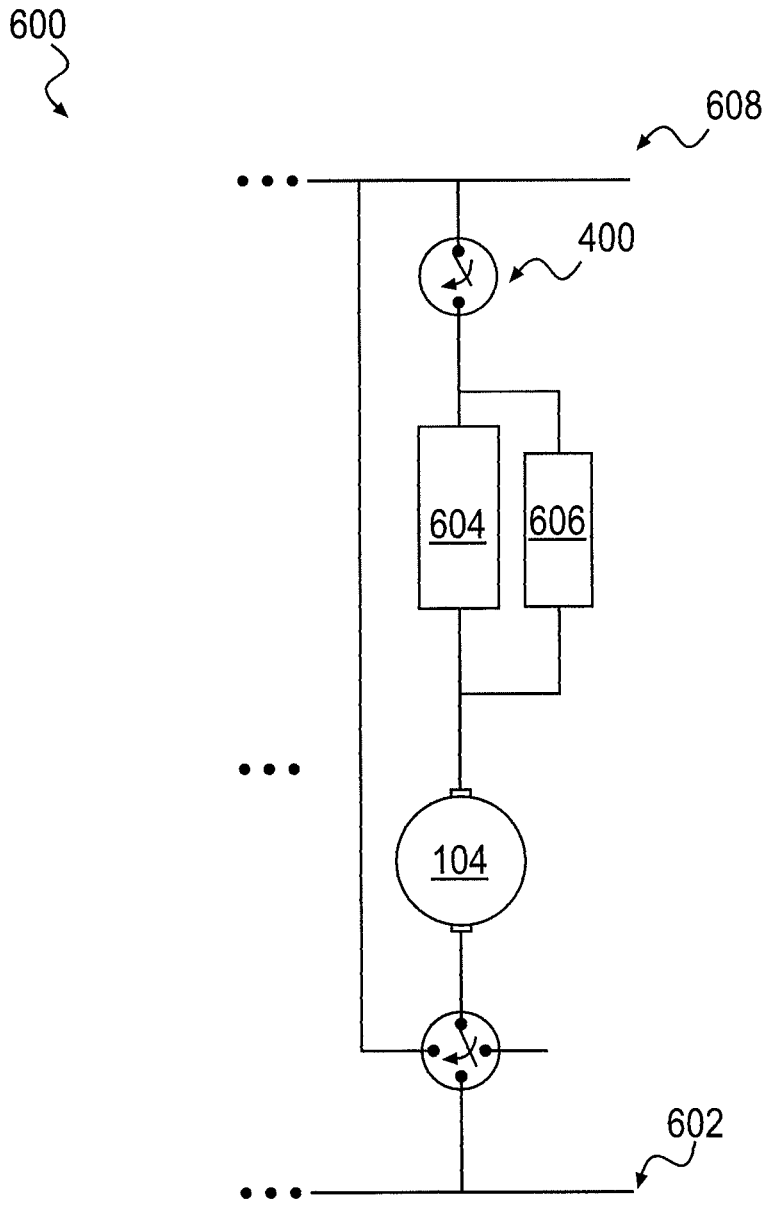
FIG. 6 illustrates a power transmission circuit.

Power contactor 400 may be suited for applications within a high power transmission circuit. By way of example, FIG. 6 shows a schematic of an exemplary portion of a power transmission circuit 600 for powering at least one armature 104 of locomotive 100. Armature 104 may have two terminals. The first terminal of armature 104 may connect to a negative power bus 602. The second terminal of armature 104 may serially connect to a chopper 604.

Power transmission circuit 600 may include chopper 604 and a grid resistor 606 for dynamic braking. Chopper 604 may be any switched DC current regulation device. For example, chopper 604 may comprise a DC-DC chopper. As a switched DC current regulation device, chopper 604 may produce discontinuous direct current. Grid resistor 606 may be any device capable of dissipating electrical energy as heat. Grid resistor 606 may be connected in parallel with chopper 604. For dynamic braking, chopper 604 may use pulse width modulation to alter the effective resistance of grid resistor 606.

Power transmission circuit 600 may include power contactor 400 to connect chopper 604 to a positive power bus 608. As power contactor 400 is in the direct path between chopper 604 and positive power bus 608, it must be capable of operating in the primary path of discontinuous current. Power contactor 400 may disconnect chopper 604 and armature 104 from positive power bus 608.

In power transmission circuit 600, chopper 604 may regulate the primary current flow from positive power bus to armature 104 with pulse width modulation. During the "ON" portion of the cycle, positive power bus 608 supplies current to armature 104 through chopper 604, returning to negative power bus 602. During the "OFF" portion of the cycle, the armature current is discharged through chopper 604, forming a closed circuit between armature 104, negative power bus 602, and chopper 604. During high-current operation, the flow is continuous in this portion of power transmission circuit 600, while current only flows through positive power bus 608 and power contactor 400 during the "ON" portion of the cycle. When chopper 604 is in the "OFF" position, current continues to flow through armature 104, negative power bus 602, and chopper 604, such that these elements of power transmission circuit 600 experience continuous current. Alternatively, when chopper 604 is in the "OFF" position, current no longer flows from positive power bus 608 through power contactor 400 and chopper 604, such that these elements of power transmission circuit 600 experience discontinuous current.

INDUSTRIAL APPLICABILITY

The disclosed methods for manufacturing a power contactor capable of operating under discontinuous current conditions described herein provide a robust solution for enhancing the operability of power transmission circuits by eliminating the risk of the power contactor overheating when subject to discontinuous current. Specifically, because the presently disclosed power contactor provides a primary conducting coil having a nonmetallic core, which acts as an insulator rather than a conductor, it is resistant to heat that is generated by induction caused by frequent changes in current associated with pulse width modulation applications. Furthermore, by partly removing the magnetic amplifier from a preexisting contactor in accordance with certain exemplary embodiments, the disclosed method of manufacturing a power contactor provides a reliable solution for maintaining operability of power contactors in discontinuous current without the need to redesign a new power contactor.

The presently disclosed method of manufacture may have several advantages. By partially removing components from a known power contactor, this method provides a simple solution to the overheating problem without requiring redesign of the power transmission circuit. Additionally, as the conventional contactor is proven reliable in continuous current conditions, the power contactor will maintain the reliability of the legacy component in discontinuous applications.

Furthermore, because conventional contactors having magnetic amplifiers (which can operate under normal DC operating conditions characterized by continuous current) can be modified using the presently disclosed methods to operate under pulsed or discontinuous current conditions, maintaining a stock of high power contactors for both discontinuous and continuous applications will require only the total number of contactors needed, as one type can be modified to become the other.

It will be apparent to those skilled in the art that various modifications and variations can be made to the disclosed locomotive power contactor and associated methods for manufacturing the same. Other embodiments of the present disclosure will be apparent to those skilled in the art from consideration of the specification and practice of the present disclosure. It is intended that the specification and examples be considered as exemplary only, with a true scope of the present disclosure being indicated by the following claims and their equivalents.

What is claimed is:

1. A method of manufacturing a power contactor from an existing contactor having a magnetic amplifier that comprises a blowout coil and a ferromagnetic core, and an arc chute for extinguishing an arc generated by an opening of the power contactor under a current load, the method comprising:

removing a bolt assembly from the existing contactor;

removing at least one side plate from the existing contactor;

removing the ferromagnetic core from the existing contactor; and inserting a nonmagnetic core into the blowout coil.

2. The method of claim 1, wherein the power contactor is a single-pole, single-throw switch capable of operating in the primary path of discontinuous current.

3. The method of claim 2, wherein the power contactor is capable of withstanding 2000 ADC.

4. The method of claim 1, wherein the nonmagnetic core comprises a nonmetallic core.

5. The method of claim 4, wherein the nonmagnetic core comprises a dielectric core.

* * * * *